US009124006B2

(12) United States Patent
Ding

(10) Patent No.: US 9,124,006 B2
(45) Date of Patent: Sep. 1, 2015

(54) ANTENNA ARRAY FOR ULTRA WIDE BAND RADAR APPLICATIONS

(75) Inventor: Xueru Ding, Chelmsford, MA (US)

(73) Assignee: Autoliv ASP, Inc., Ogden, UT (US)

( * ) Notice: Subject to any disclaimer, the term of this patent is extended or adjusted under 35 U.S.C. 154(b) by 1017 days.

(21) Appl. No.: 13/046,320

(22) Filed: Mar. 11, 2011

(65) Prior Publication Data

US 2012/0229366 A1 Sep. 13, 2012

(51) Int. Cl.

*H01Q 21/06* (2006.01)
*H01Q 9/04* (2006.01)
*H01Q 21/00* (2006.01)

(52) U.S. Cl.

CPC ..... *H01Q 21/065* (2013.01); *H01Q 9/045* (2013.01); *H01Q 9/0414* (2013.01); *H01Q 9/0457* (2013.01); *H01Q 21/0006* (2013.01); *H01Q 21/0075* (2013.01)

(58) Field of Classification Search

CPC ... H01Q 21/065; H01Q 21/0006; H01Q 1/38; H01Q 9/0414; H01Q 9/0457; H01Q 9/045; H01Q 21/0075

USPC ..... 343/700 MS

See application file for complete search history.

(56) References Cited

U.S. PATENT DOCUMENTS

| | | | | |
|---|---|---|---|---|
| 4,686,535 | A * | 8/1987 | Lalezari | 343/853 |
| 6,031,491 | A * | 2/2000 | Daniel et al. | 343/700 MS |
| 8,063,832 | B1 * | 11/2011 | Weller et al. | 343/700 MS |
| 2005/0099358 | A1 * | 5/2005 | McCarrick | 343/853 |
| 2008/0074324 | A1 | 3/2008 | Puzella et al. | |
| 2009/0051619 | A1 | 2/2009 | Hook et al. | |
| 2010/0171675 | A1 | 7/2010 | Borja et al. | |
| 2010/0225528 | A1 | 9/2010 | Shijo et al. | |

OTHER PUBLICATIONS

"International Search Report", Mailed Date: Jul. 11, 2012, Application No. PCT/US2012/24596, Filed Date: Feb. 10, 2012, pp. 9.

* cited by examiner

*Primary Examiner* — Robert Karacsony

(74) *Attorney, Agent, or Firm* — Burns & Levinson, LLP; Steven M. Mills

(57) ABSTRACT

A low profile antenna array for UWB radar antenna applications is disclosed. It may be used as a mid-range receiving antenna array (RXM) or as a mid-range transmitting antenna array (TXM). In some embodiments, the RXM or the TXM may include a plurality of radiation patch elements formed on a top layer of a printed circuit board (PCB), a distribution feeding network in the mid-layer of the PCB having a patch array, and a serial feeding arrangement from a λ/4 coupling slot to each feeding patch. This antenna may have a desirable large frequency bandwidth with relatively flat antenna gain over a frequency range from 22 GHz to 26.5 GHz. In addition, sidelobe levels for the elevation patterns may be below −20 dB. Other embodiments are disclosed and claimed.

6 Claims, 13 Drawing Sheets

90°
60°
30°
0°
330°
300°
270°
240°
210°
180°
150°
120°
90°
60°
30°
0°
-30°
-60°
-90°
-120°
-150°
-180°
-210°
-240°
-270°
-300°
-330°
Azimuth
Elevation
Azimuth
Elevation
Azimuth
Elevation

ANTENNA ARRAY FOR ULTRA WIDE BAND RADAR APPLICATIONS

BACKGROUND

1. Field of the Invention

Embodiments of the invention generally relate to the field of radar system antennas, and more specifically to patch antenna arrays suitable for use in ultra-wide-band radar applications.

2. Discussion of Related Art

Radar is used in many applications to detect target objects such as airplanes, military targets, and vehicles. More recently, radar systems have been implemented in automobiles. Automotive radar systems are known for use in helping drivers to park their cars, to follow traffic at a safe distance, and to detect driving obstacles. In such applications, when the radar system detects an obstacle or the slowing down of traffic in front of the vehicle, it may issue a warning to the driver, such as a beep or warning light on the dashboard, and/or actually control the vehicle in some way, such as by applying the brakes, in order to avoid an accident.

For example, a radar system may detect the range (i.e., distance) to a target object by determining the roundtrip delay period between the transmission of a radar signal and the receipt of the signal returning back to the radar after it bounces off of the target object. This round-trip delay, divided in half and then multiplied by the speed of the radiation, c, gives the distance between the radar system and the target object (assuming the transmitting antenna and the receiving antenna are the same antenna or very close to each other).

As can be appreciated, it would be desirable to provide radar antenna structures for automobile applications that can be implemented in a compact volume, and which also can be provided at a low cost.

SUMMARY OF THE DISCLOSURE

A set of low profile antenna arrays is disclosed for UWB radar antenna applications. The antenna arrays may include a plurality of arrays arranged for particular performance characteristics. For example, a UWB radar antenna may include mid-range receiving antenna array (RXM), a short-range receiving antenna array (RXS), and a pair of transmitting antenna arrays (TX1 and TX2). In some embodiments, the RXM consists of 12×12 radiation patch elements formed on a top layer of a printed circuit board (PCB), a distribution feeding network in the mid-layer of the PCB having a 6×6 feeding patch array, and a serial feeding arrangement from a λ/4 coupling slot to each feeding patch. All antennas may have a desirable large frequency bandwidth with relatively flat antenna gain over a frequency range from 22 to 26.5-GHz. In addition, measured sidelobe levels for the elevation patterns are below −20 dB.

BRIEF DESCRIPTION OF THE DRAWINGS

The accompanying drawing illustrates an exemplary embodiment of the disclosed device so far devised for the practical application of the principles thereof, and in which.

DESCRIPTION OF EMBODIMENTS

Figure 1:
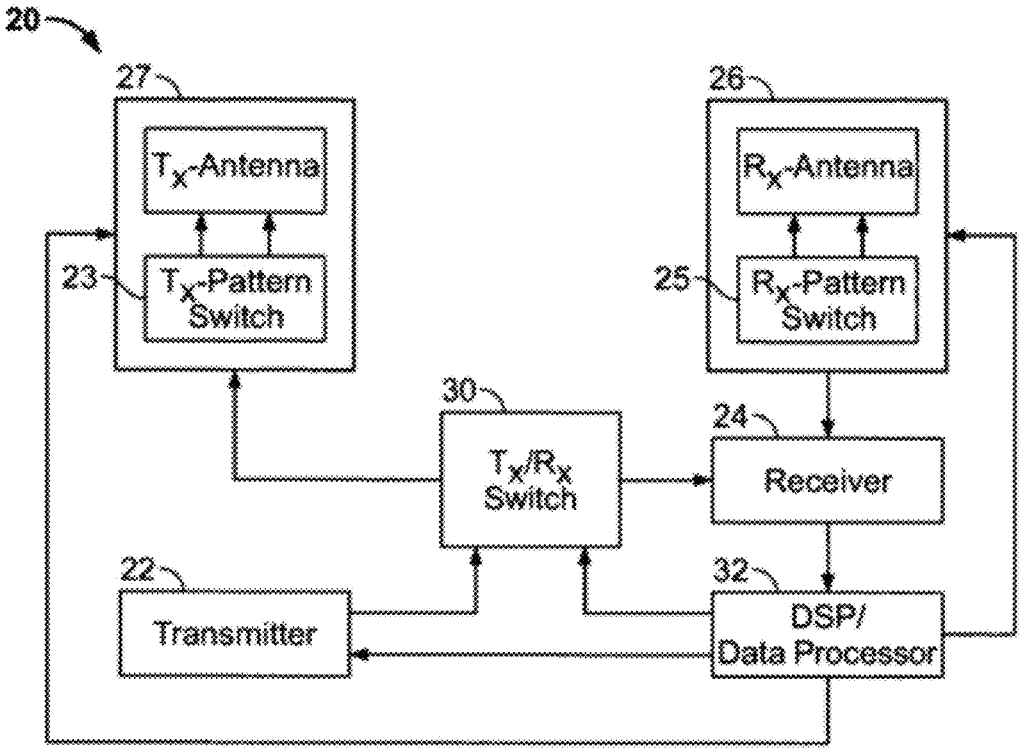
FIG. 1 is a block diagram of a radar system in accordance with one or more embodiments.

Ultra-wide-band (UWB) radar systems for use in automotive applications should have large frequency bandwidth, and should be simple to fabricate at a low cost. Typical microstrip patch antenna arrays present a relatively low cost option, however, traditional patch antenna arrays have relatively narrow bandwidth, and suffer from signal leakage from the associated feeding network. One way to minimize feeding network losses and unwanted radiation from the feeding network is to use a four element sub-array. With such a sub-array, a plurality of radiation patches are excited by a resonant patch positioned beneath the radiation patches. The bandwidth of the resulting sub-array antenna may be increased through this resonant coupling, while relatively higher antenna gain is achieved through the configuration of a plurality of patches having high radiation efficiency.

The broad bandwidth and high gain characteristics make the sub-array structure a good choice as a radiation element of an UWB automotive antenna array. To meet regulatory emissions requirements and to minimize the reception from the off-sight targets, such as the guardrails, the metal bridge frames, etc, however, automotive antennas must also have very low sidelobe radiation while maintaining desired high efficiency. Consequently, a large array may be needed. In addition, for mid- and short-range radar applications, both high and low gain antennas may be required. To eliminate issues associated with target angle detection ambiguity, two columns of radiation arrays may be provided very close to each other (i.e., within less than or equal to a half-wavelength (λ/2)). To build a large array from such four element sub-arrays without sacrificing bandwidth and high antenna gain is a challenge due to the presence of field interference from the feeding network and from the feeding patches disposed between the radiation layer and the antenna ground. Another challenge is that the top four patches of a sub-array may be limited in the amount of space they are allowed to occupy.

The disclosed UWB radar array design may include a feeding network with a feeding patch structure that can be provided in a small area, at a low cost, and with excellent performance. In some embodiments, such an array may be suitable for use in 24~26 GHz automotive radar applications.

A patch antenna arrangement is disclosed for use in ultra-wide-band (UWB) radar systems applications. Patch antennas may be desirable because they can be fabricated in a compact arrangement which makes them suitable for automotive applications. In one embodiment, a patch antenna comprises a flat, square radiating patch, a feed line for feeding a signal to the patch (or for receiving a signal from the patch, if it is a receiving antenna rather than a transmitting antenna) and a ground plane disposed beneath the patch and separated from it by a dielectric (which in some embodiments may be air). The feed line may comprise a microstrip disposed on one side of a substrate, or a strip line disposed in the middle of two substrates joined face to face (the strip line being formed on one of the substrates) with two opposing ground planes formed on the opposing outside surface of each of the substrates, respectively.

The "length" of the patch may be selected to be one half of the wavelength (λ) of the signal that the patch is intended to radiate (or receive), so that the patch resonates at the frequency of the signal and thereby transmits/receives the desired wireless signal. The "length" of a patch antenna generally refers to the distance between the radiating edges of the patch. Thus, for example, in a square patch, this would be the length of a side of the square.

In some embodiments, the feed line of a patch antenna may be coupled directly to the patch in order to directly drive (or receive) the signal. In other embodiments, the patch antenna may be parasitically capacitively driven from a proximity coupled feed line.

A radar system constructed according to various embodiments is shown in FIG. 1. The radar system 20 is provided in one embodiment in a pulsed Doppler configuration that generally includes a transmitter 22 connected to at least one transmit antenna (TX-antenna) 27, through a transmit/receive (TX/RX) switch 30. The TX-antenna 27 may include, for example, a pattern switch 23. A receiver 24 may be connected to a receive antenna (RX-antenna) 26 the TX/RX switch 30 and a signal processor, for example, a digital signal processor (DSP)/data processor 32. The RX-antenna 26 may include, for example, a pattern switch 25. The DSP/data processor 32 is also connected to the transmitter 22, and the TX-antenna 27 through the TX/RX switch 30. The TX/RX switch 30 may be connected to each of the RX-antenna 26 and TX-antenna 27 as a local oscillator.

In operation, the radar system 20 may operate in a pulsed Doppler operation mode transmitting pulses from TX-antenna 27, with the return signals received using the receiver 24 and RX-antenna 26. It will be appreciated that other operation modes (e.g., frequency-modulated-continuous-wave (FMCW), coherent frequency system with frequency hopping, etc.) may also be used. The antenna beam configuration may be controlled by the RX-pattern switch 25. The RX-pattern switch 25 may include, for example, a pair of PIN switch diodes (not shown), or a monolithic microwave integrated circuit (MMIC) switch chip to switch between the two different antenna beam configurations. In one exemplary embodiment, the radar system may include a mid-range receiving antenna array (RXM), a short-range receiving antenna array (RXS), a pair of TX-antenna arrays (TX1 and TX2), a TX-pattern switch, a transmitter 22, a receiver 24, and a DSP/Data processor 32.

Figure 8:
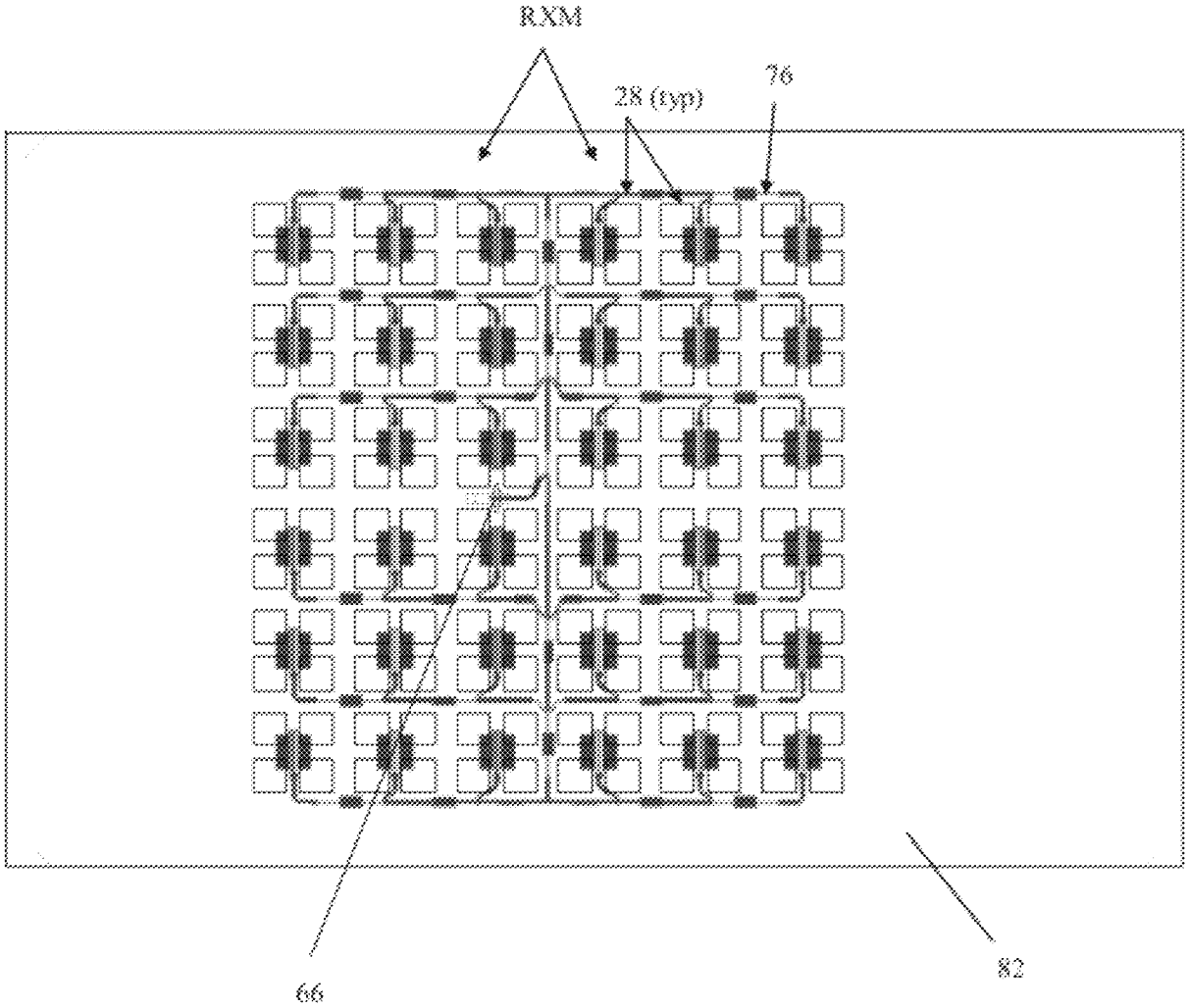
FIG. 8 shows an exemplary array of RXM antenna array elements.

In various embodiments, at least one of the RX-antenna and at least one TX-antenna may be configured having a plurality of antenna array columns (see FIG. 8). In other embodiments, the radar system may include a plurality of RX antennas and a plurality of TX antennas.

Figure 2:
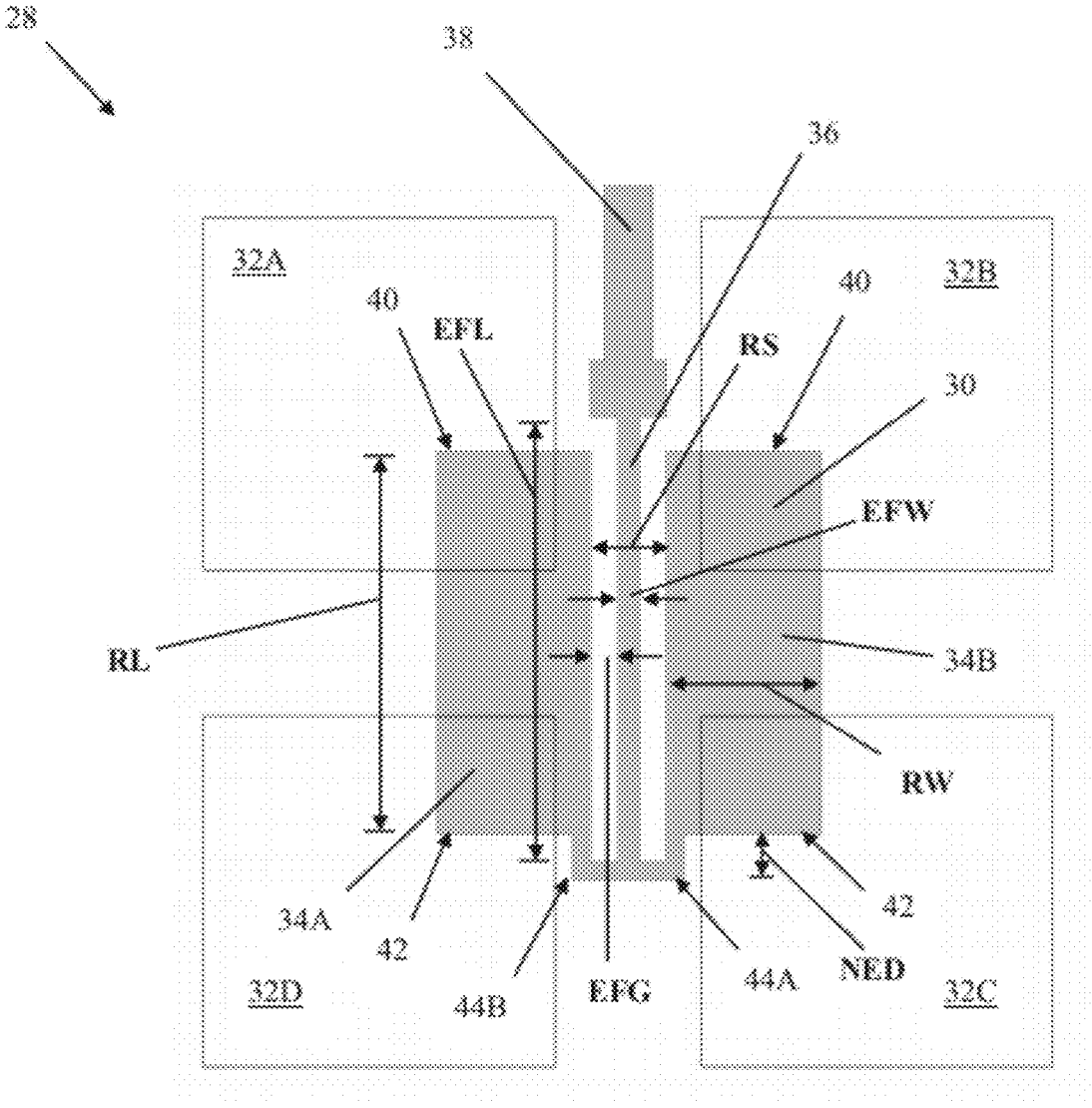
FIG. 2 shows an exemplary end-feeding structure for use with a feeding patch of an antenna sub-array with four radiation patch elements.

Referring now to FIG. 2, an exemplary embodiment of a patch antenna structure 28 for use in mid-range receiver (RXM) applications is shown. In some embodiments, a mid-range radar may have a detection range up to about 80 meters, though other ranges are also contemplated. In addition, it will be appreciated that although the structure is described in relation to an RXM application, the structure is not limited to such applications. In some embodiments, an end-feeding patch resonator 30 is associated with a plurality of radiation patches 32A-D. In the illustrated embodiment, each of the radiation patches 32A-D may have a square configuration with side lengths "L." It will be appreciated that other patch geometries (e.g., circular, rectangular, triangular) may also be used. For the rectangular radiation patches 32A-D, the length is chosen for the resonance, while the width is chosen for the impedance matching. In addition, although the illustrated embodiment shows four radiation patches 32A-D, greater or fewer radiation patches may also be used.

In some embodiments, the radiation patches 32A-D are resonant patches. In other embodiments, the radiation patches 32A-D are non-resonant patches.

The patch resonator 30 may have a split-feed design comprising first and second resonator portions 34A, B and an end-feeding portion 36. The resonator portions 34A, B may be positioned to underlie at least a portion of each of the four radiation patches 32A-D. As illustrated, first resonator portion 34A underlies a portion of patches 32A and 32B, while second resonator portion 34B underlies a portion of patches 32C and 32D.

First and second resonator portions 34A, B may have a length "RL" and a width "RW." In addition, the first and second resonator portions 34A, B may be separated by a lateral separation distance "RS." This lateral separation distance "RS" may be large enough to enable the end-feeding portion 36, which has a length "EFL" and a width "EFW", to be disposed between the resonator portions 34A, B, and to be separated from the portions 34A, B by a gap "EFG." This arrangement enables the end-feeding portion 36 to connect to an RF feed source 38 adjacent a first end 40 of each of the resonator portions, and to connect to the first and second resonator portions 34A, B at their second ends 42. As can be seen, near the second ends 42 of the resonator portions the end feeding portion 36 splits into first and second notch segments 44A, B. In the illustrated embodiment, these notch segments 44A, B are "L"-shaped so they can connect to the second ends 42 at a substantially perpendicular angle. It will be appreciated, however, that the segments 44A, B could alternatively be straight so as to connect to the resonator portions 34A, B at an angle substantially parallel to the second ends 42. The notched segments 44A, B may extend beyond the second end 42 of the resonator portions 34A, B by an extension distance "NED."

The disclosed end-feeding patch resonator structure may minimize undesirable radiation effects from the feeding lines in the structure's sub-layer, and may make maximum use of the limited area available for feeding portion 36. Notably, the disclosed feeding portion 36 may act as an impedance transformer, in which all of the dimensions of the end-feeding portion 36, including length "EFL," width "EFW," and the geometry of the notch segments 44A, B, the extension distance "NED" as well as the gaps "EFG" between elements, can be adjusted to obtain a desired inductance and capacitance of the feed 36. This ability to adjust the geometry of the end feeding portion 36 provides substantial impedance matching flexibility, which may eliminate the need to incorporate additional impedance matching components or structure to obtain a desired performance.

Figure 3B:
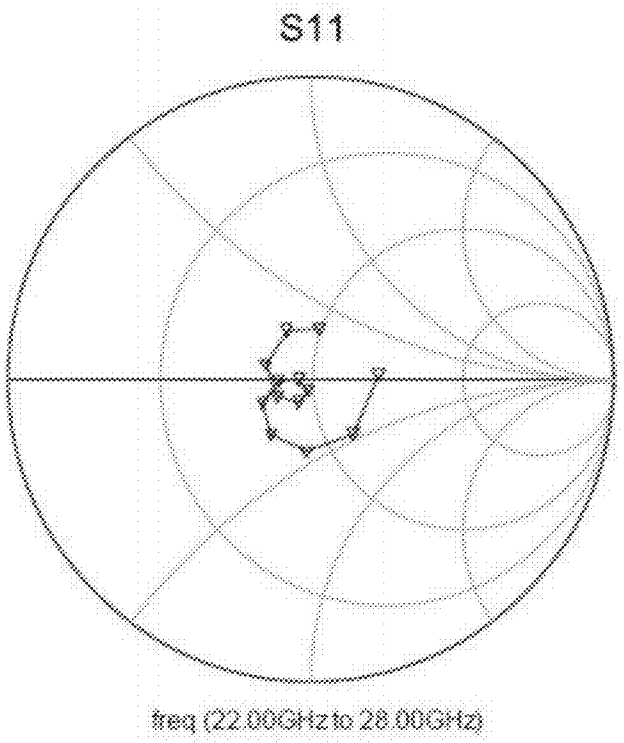
FIGS. 3A and 3B show simulated return loss of a patch antenna sub-array excited by the end-feeding patch of FIG. 1.
Figure 3A:
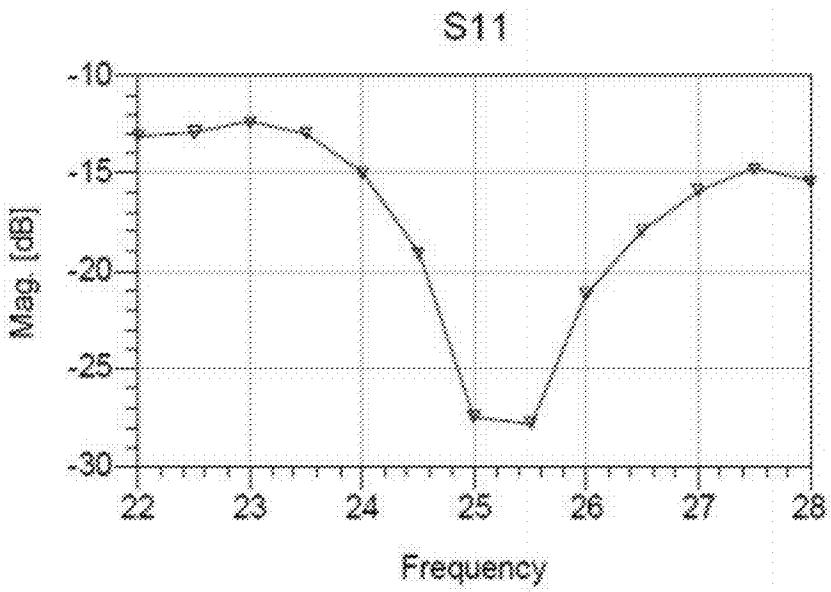

FIGS. 3A and 3B show simulated return loss results of the disclosed patch antenna structure 28. As can be seen, a return loss below −10 dB over the frequency band from 22-GHz to 28-GHz is obtained. For the illustrated simulation, the end-feeding patch 30 and its feeding transmission line 36 are assumed to be positioned in the sub-layer about 0.008-inches away from the grounding metallization 46, separated by dielectric material 48 having a permittivity (∈r) of about 3.52 (see FIG. 4). The four radiation patches 32A-D are assumed to be positioned on a 0.031-inch thick substrate 50 having a permittivity (∈r) of about 3.00. As it can be seen from FIG. 4, a third dielectric layer 52 having a thickness of about 0.012-inches and a permittivity (∈r) of about 3.55 is positioned below the grounding metallization 46 to support a driving RF-circuit 54 on a side of the device opposite the radiation patches 32A, 32B. As will be appreciated, the RF feed energy is coupled through a slot 56 in the ground plane 46 to the array feeding network 36.

The disclosed layer thicknesses and permittivities are selected only as an example in this embodiment for one specific design to meet 24-26 GHz operational requirements, and thus other materials, thicknesses, and layer combinations may be employed where the antenna is intended to operate in different frequency ranges, or same frequency ranges for different applications.

The end-feeding patch 30, radiation patches 32A-D, ground metallization 46, dielectric layers 48, 50, 52 and slot 56 may be created using conventional semiconductor manufacturing techniques such as depositing one or more layers by any one of a number of known techniques and etching them by any one of a number of techniques known in the semiconductor fabrication industry to create metallizations, (i.e., the ground plane, end-feeding patch, and radiating patches). The feed slot 56 may be coupled to an RF drive signal, and may capacitively drive a signal on the end-feeding patch 30.

To minimize the secondary radiation and to eliminate the need for using plated ground via-holes in the antenna side of the radar system 20, a λ/4 "narrow-cross" shaped slot coupling structure 66 (FIG. 5) may be provided between the RF source 68 and feed leg 71 which couples to the antenna feeding network 70. As shown, the slot structure 66 includes first and second slot portions 66A, 66B combined as a "narrow cross"-shape. In some embodiments, these slot portions 66A, 66B are formed in the ground plane (see, e.g., slot 56 in ground plane 46, shown in FIG. 4). The resulting "narrow cross"-shape may provide a notched bandwidth for matching over a wide bandwidth. As noted, this slot structure 66 provides a λ/4 resonance and results in lower leakage power as compared to λ/2 resonant slots. In addition, the slot structure 66 is capable of maintaining a desired frequency bandwidth and high energy transfer efficiency from the RF source 68 and transmission line stub 67 to the RF feeding network 70.

As will be appreciated, providing a cross-shaped slot 66 provides design flexibility in which all of the dimensions associated with the first and second slot portions 66A, B can be adjusted, thus providing desired impedance matching. For example, the first slot portion 66A may have a length "FSL," and a width "FSW," while the second slot portion 66B may also have a length "SSL" and a width "SSW." It will be appreciated that the described geometric relationships can further enhance the design flexibility of the system to enable finer control over impedance matching of the RF course 68 to the associated antenna structures.

In addition, providing a field polarization of the slot perpendicular to the radiation element field polarization of the patches minimizes the contribution of slot radiation to the antenna sidelobe and therefore to minimize the interferences from other unwanted reflections from the targets such as guardrails, traffic signs, and metal bridge frames.

Figure 6:
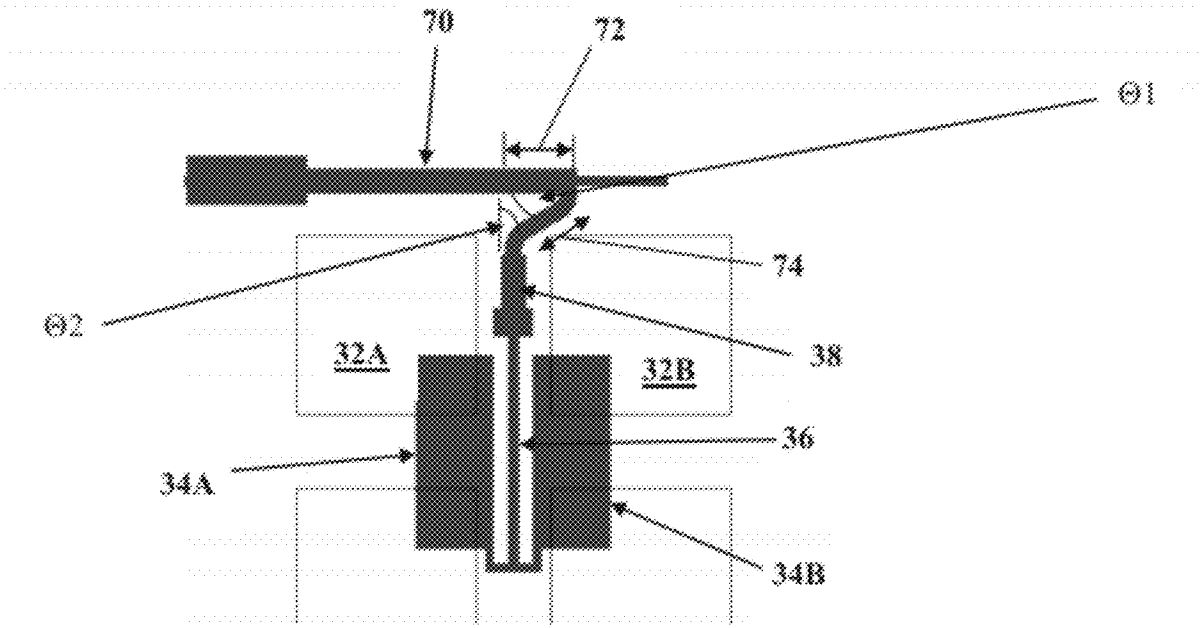
FIG. 6 shows an antenna feeding network with an in-line phase adjustment feature.

Due to the density of the disclosed patch arrangement, there may be little space available for phase adjustment of the feeding network. Thus, in-line phase adjustment may be provided for the disclosed design. Such in-line phase adjustment uses the forwarding distribution transmission line 70 as part of the phase adjustment, and combines a section of the returning trace 74 to achieve an overall phase compensation value for the even phase excitation of the radiation patches 32A-D. In FIG. 6, the trace section marked as 72 is shown in the forwarding distribution transmission line 70 and the trace section marked as 74 is the returning trace. The geometry of these sections 72, 74, including their respective lengths, and the angles θ1, θ2 at which the returning trace 74 intersects with the feed 36, 38 and the forwarding distribution transmission line 70, respectively, can be adjusted to achieve a desired phase adjustment. This is an improvement over conventional arrangements which use a curved or a bent branch transmission line to obtain phase adjustment, which, as can be appreciated, requires additional space as compared to the disclosed arrangement.

Figure 7:
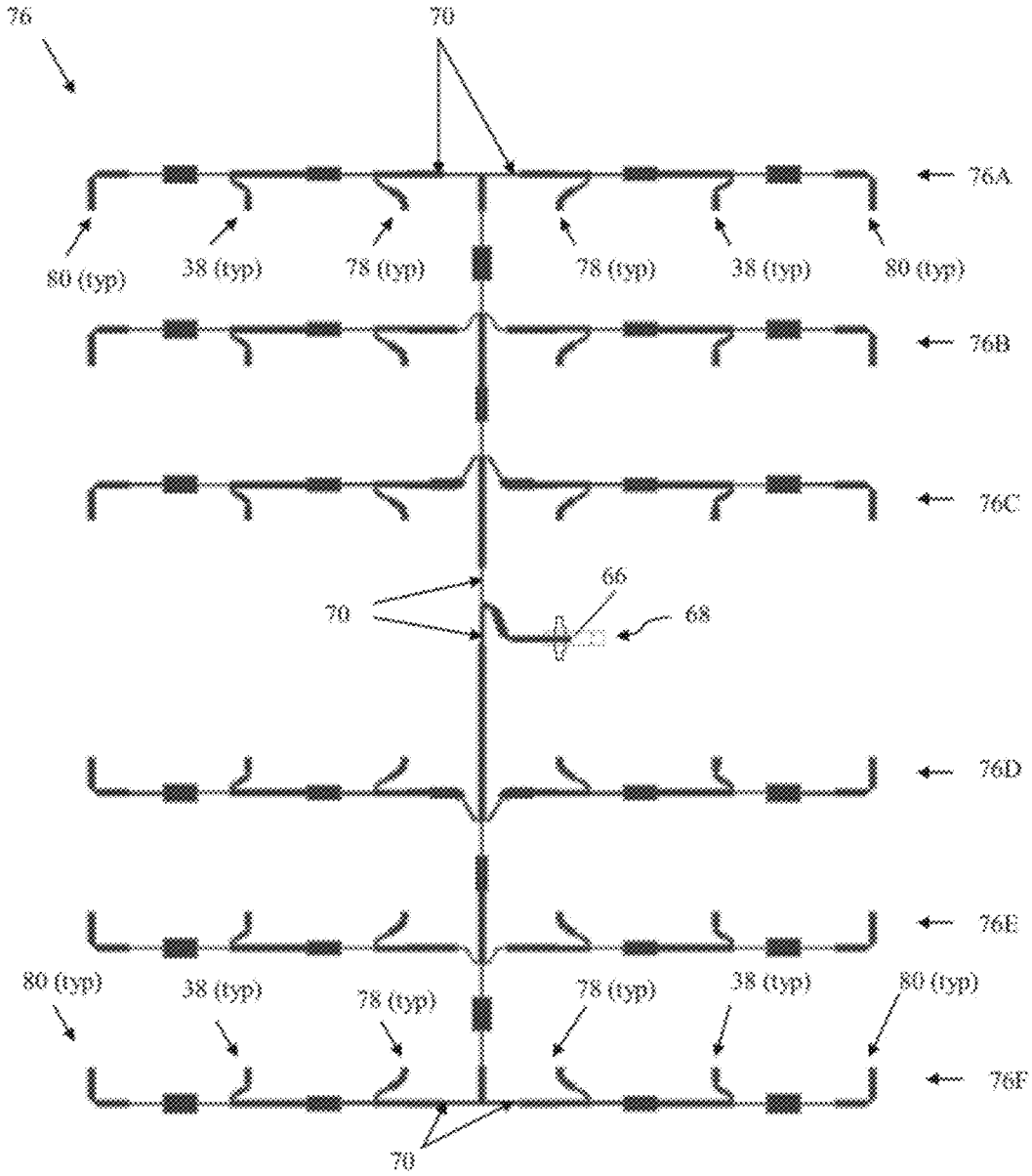
FIG. 7 shows an exemplary serial feeding structure for an embodiment of a mid-range receiving antenna.

Referring to FIG. 7, an exemplary serial distribution structure 76 is shown for use as a feeding network for one or more of the disclosed arrays. Since the feeding network 76 is positioned between the ground plane 46 (FIG. 4) and the radiation element layer (32A, B, FIG. 4) and is mostly covered by the radiation patches 32A-D, a complicated structure can have very negative impact on the radiation pattern and antenna efficiency through the leakage radiation. Thus, the disclosed serial distribution structure 76 reduces such impact. In addition, the disclosed serial distribution structure 76 makes it easier to implement a coupling structure from the RF-circuit 68 to the feeding network 70 by using a single slot 66 structure for each antenna array, and therefore the leakage and interference from the slot 66 can be minimized. The serial distribution structure 76 provides desired coupling between the RF circuit 68, distribution transmission lines 70, and the individual patch antenna structures 28 via feed structures 38, 78, 80. The feed structures 38, 78 and 80 have different returning lengths 72 and 74, and angles θ1, θ2 to achieve designed feeding phases to each radiation element 32 A-D group.

FIG. 7 depicts a serial distribution network of 6×6 feeding branches 76A-F of a mid-range receiver antenna array (RXM). It will be appreciated, however, that such an arrangement is not limited to RXM arrays, and can be used in a variety of array applications.

Referring to FIG. 8, an exemplary antenna arrangement comprises a medium range receiver array (RXM). The RXM array includes a 12×12 array of resonant radiation elements 32A-D fed by a 6×6 array of feeding patches coupled to serial distribution network 76. It will be appreciated that the illustrated arrangement is but one example, and that the RXM array can use greater or fewer feeding patches, radiation elements, feeding structures, distributions and/or arrangements.

Figure 4:
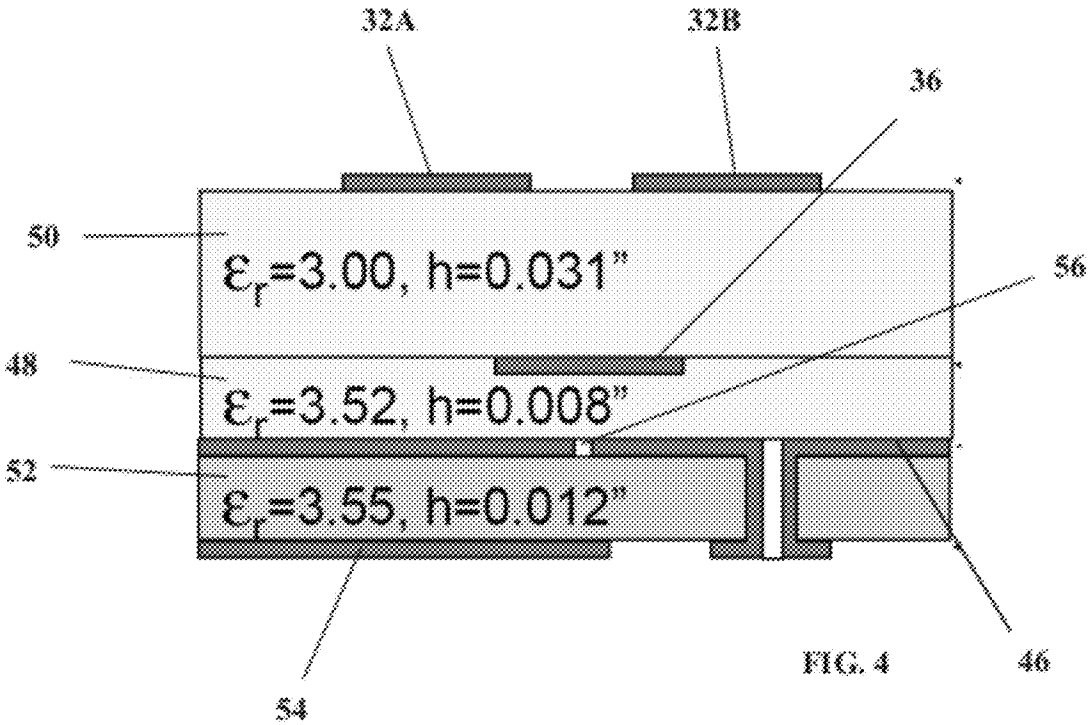
FIG. 4 shows an exemplary stack-up of layers for a patch antenna sub-array.
Figure 5:
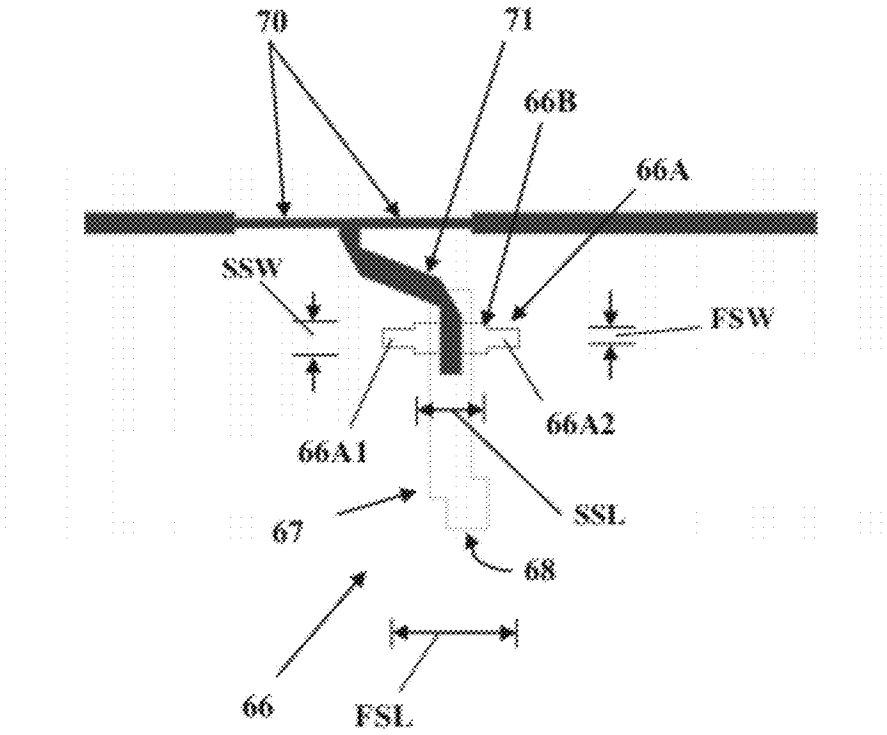
FIG. 5 shows an exemplary ground plane coupling slot for use in feeding a patch antenna sub-array.

As previously mentioned, each feeding network 76 may be excited by a single λ/4 narrow-cross-shape slot 66 in the ground plane 46 (FIG. 4). In some embodiments, the slot 66 is fed via a microstrip feeding line 67 (positioned as element 54 in FIG. 4) disposed on the RF-circuit side of the device. In an exemplary embodiment, the RXM array may be fit onto a single board 82 having a dimension of about 2.25"×2.25", thus illustrating the compact nature of the disclosed radar system.

Figure 9:
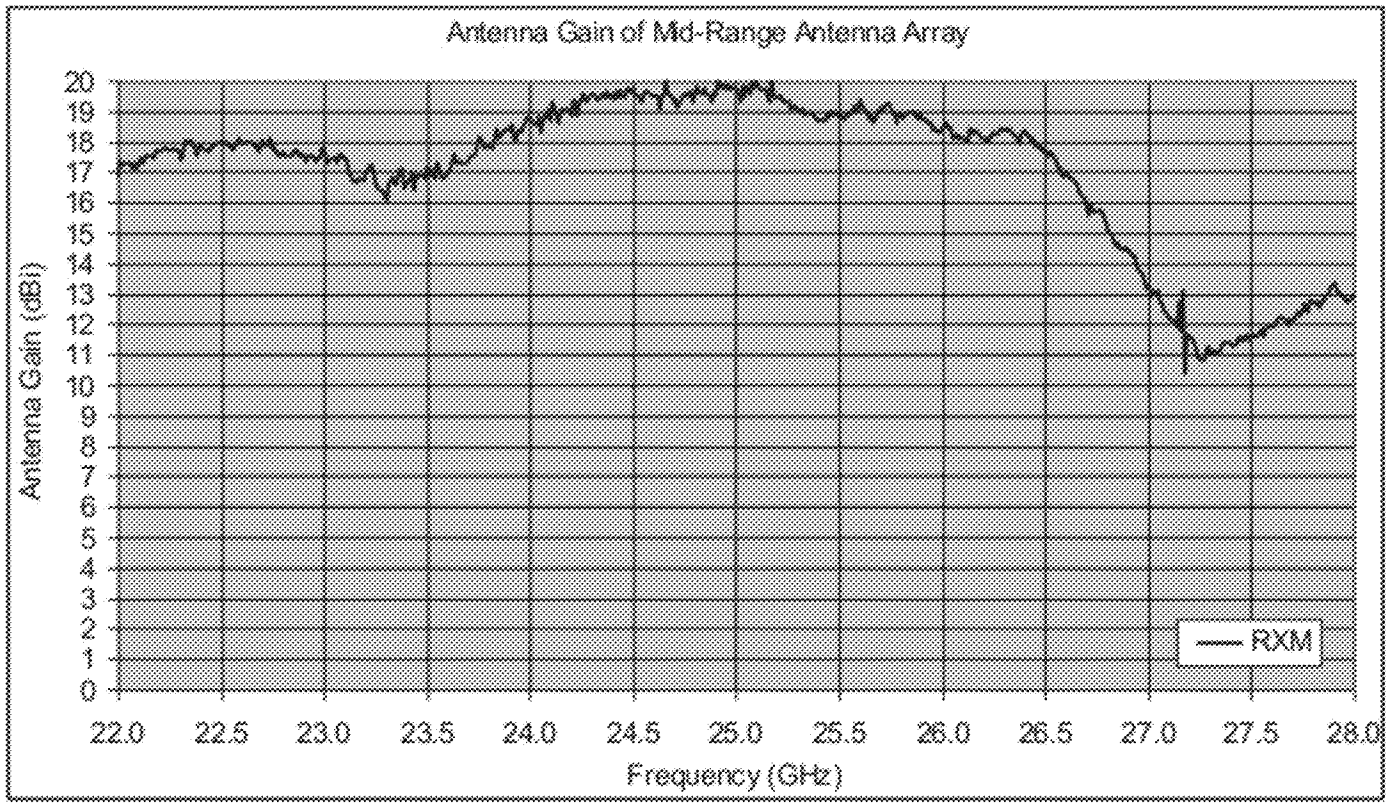
FIG. 9 shows antenna gain curves vs. frequency for an antenna array having 12×12 radiation patch elements with 6×6 feeding patches (RXM)

The stack-up structure illustrated in FIG. 4 is used for the board 82 of FIG. 8. In FIG. 9, it can be seen that the measured antenna gain of the 12×12 radiation patch array with a radiation aperture size of about 1.8"×1.8" (i.e., RXM) is about 19-dBi and with 3-dB bandwidth almost from 22.0 to 26.5-GHz.

Figure 10:
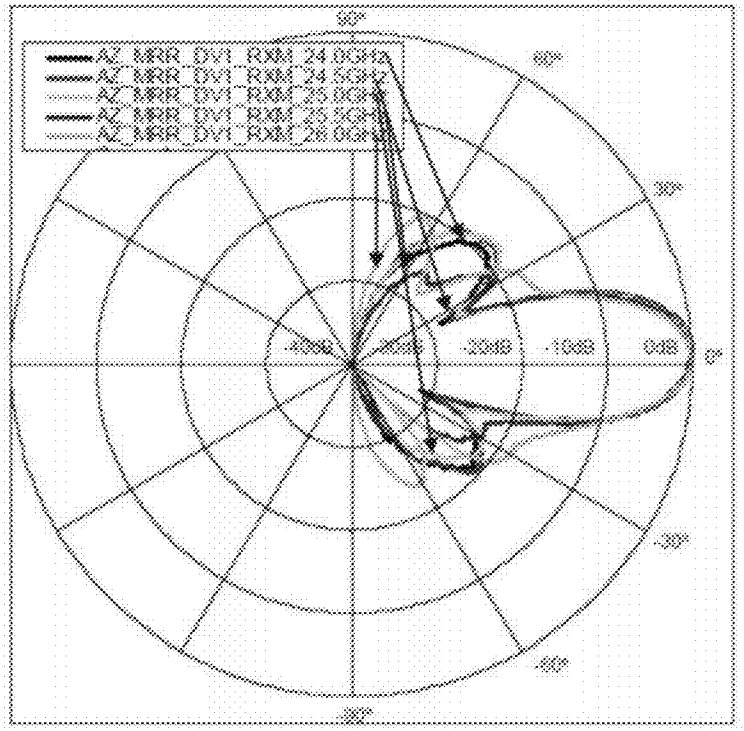
FIGS. 10A and 10B are polar plots showing azimuth and elevation patterns, respectively, for an exemplary RXM array at 24.0, 24.5, 25.0, 25.5 and 26.0 GHz.

The azimuth and elevation patterns of the antenna were tested for the RXM antenna array. The azimuth and elevation patterns of the RXM antenna array are illustrated in FIGS. 10A and 10B. As can be seen, the measured sidelobe levels of the RXM antenna radiation patterns are all below −20 dB for both the azimuth and the elevation patterns at frequency lower than 26-GHz. This indicates clearly that the leakage radiation from the feeding network 76 and the slot 66 is very small and does not have significant impact on the antenna patterns. The measurement data also show that the half-power beam width (HPBW) of both the azimuth and the elevation patterns are about 16-degree.

Figure 11:
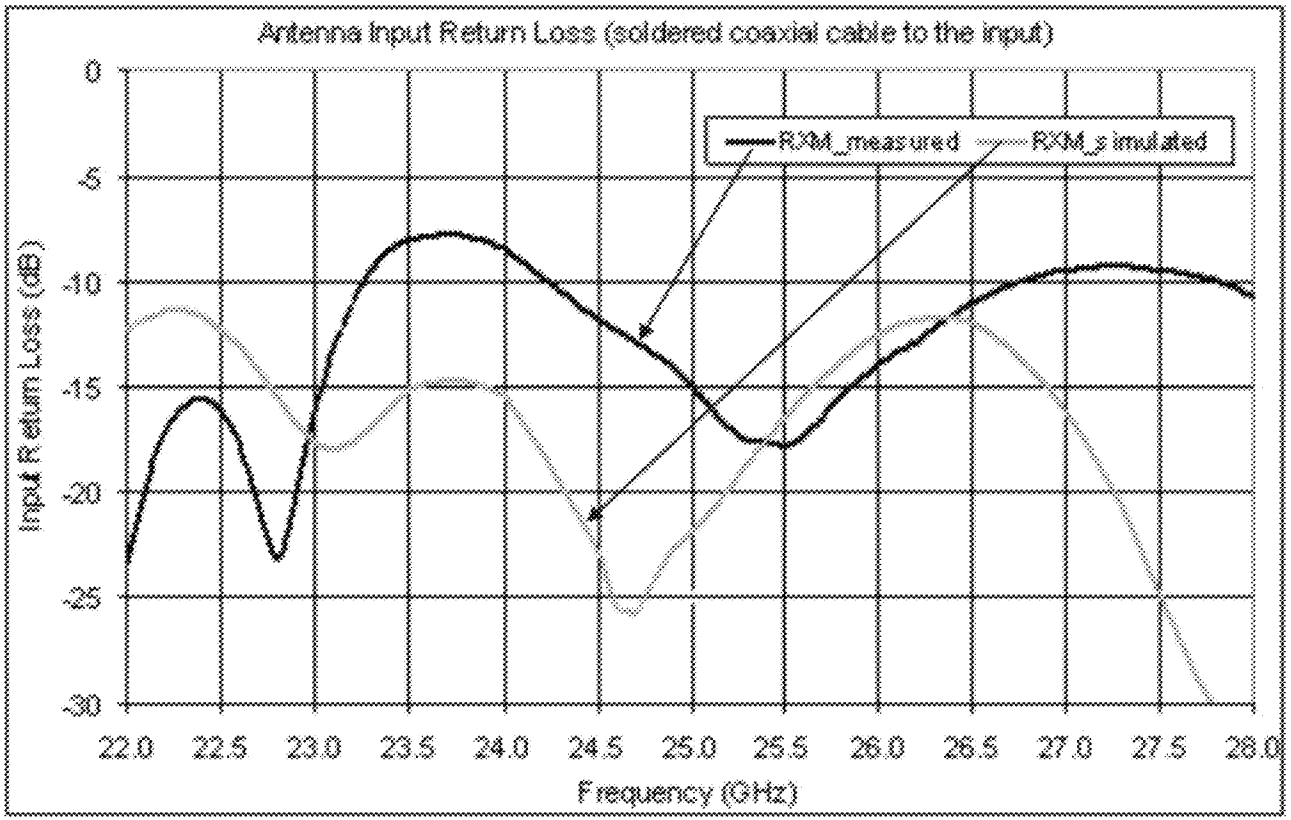
FIG. 11 shows simulated and measured results of antenna input return loss for exemplary RXM array.

The measured and the simulated results of the antenna input return loss are shown in FIG. 11. The difference between the measured and the simulated return loss results is mostly due to the fixture which has a coaxial cable soldered to the board and terminated with a SMA connector.

Figure 12:
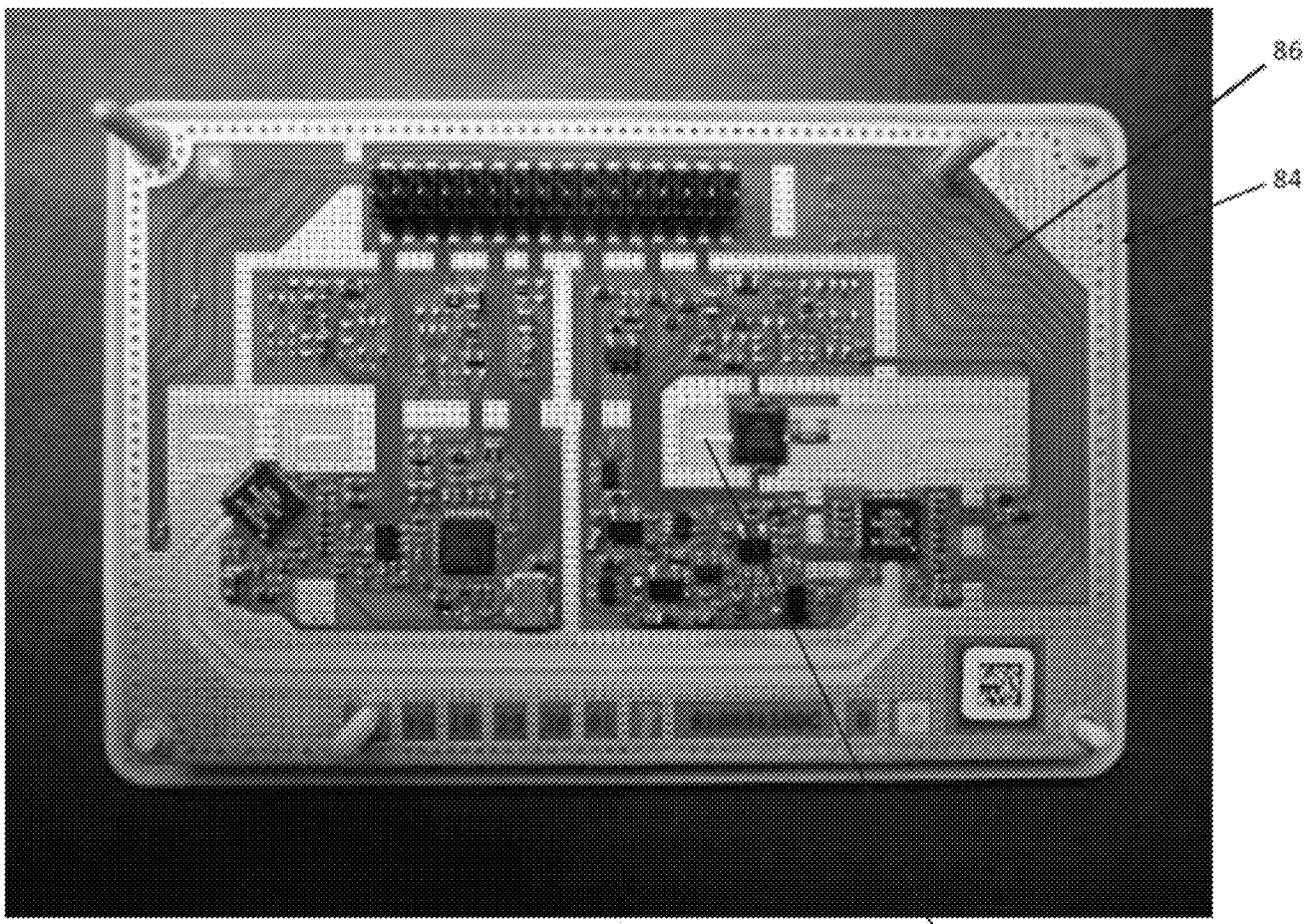
FIG. 12 shows an exemplary antenna array structure implemented in an RF board, showing a circuit side of the board.
Figure 13:
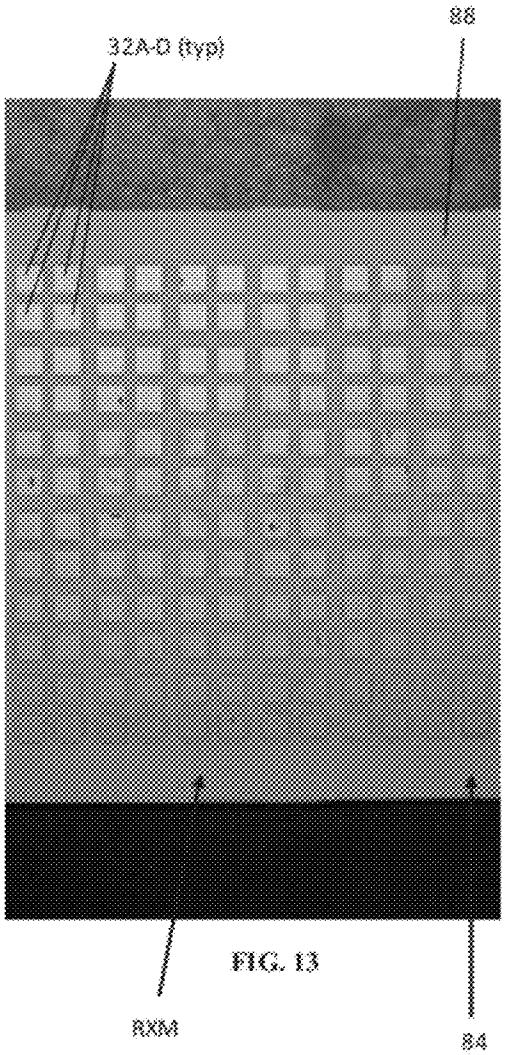
FIG. 13 shows the exemplary antenna array structure of FIG. 12 showing the radiation patch side of the board.

FIGS. 12 and 13 show the disclosed antenna array of FIG. 8 implemented in an RF board 84 of a 24-GHz to 26-GHz automotive radar. Specifically, FIG. 12 shows the circuit side 86 of the board 84, while FIG. 13 shows the radiation patch side 88 of the board.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

Some embodiments may be implemented, for example, using a machine-readable medium or article which may store an instruction or a set of instructions that, if executed by a machine, may cause the machine to perform a method and/or operations in accordance with the embodiments. Such a machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled and/or interpreted programming language.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or display devices. The embodiments are not limited in this context.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An antenna structure, comprising:

a plurality of antenna patches, the plurality of antenna patches comprising at least four antenna patches arranged in a 2×2 array of antenna patches; and a patch resonator structure coupled to the plurality of antenna patches, the patch resonator structure comprising:

first and second resonator patch portions, the first resonator patch portion being associated with and being disposed under and being coupled to a first pair of antenna patches of the 2×2 array of antenna patches to drive or receive at least one signal to or from the first pair of antenna patches, the second resonator patch portion being associated with and being disposed under and being coupled to a second pair of antenna patches of the 2×2 array of antenna patches to drive or receive at least one signal to or from the second pair of antenna patches, each of the first and second resonator patch portions having a length along a first dimension and a width along a second dimension, the length of each of the first and second resonator patch portions being larger than the width of each of the first and second resonator patch portions, each of the first and second resonator patch portions having a first end and a second end spaced apart from each other along the first dimension a distance equal to the length of the respective first and second resonator patch portions the first and second resonator patch portions being spaced a first distance apart to define a space between the first and second resonator patch portions; and a feed portion having first and second ends, the first end of the feed portion being disposed in the space between the first and second resonator patch portions at the first ends of the first and second resonator patch portions, the feed portion extending from the first end of the feed portion to the second end of the feed portion through the space between the first and second resonator patch portions and past the second ends of the first and second resonator patch portions, the second end of the feed portion splitting into a pair of leg portions, each of the leg portions being associated with one of the first and second resonator patch portions and each of the leg portions being shaped to be directed back in a direction toward its associated resonator patch portion and connecting to its associated resonator patch portion at the second end of its associated resonator patch portion, the feed portion coupled at its first end to a source of RF power.

2. The antenna structure of claim 1, wherein each of the leg portions is partially disposed parallel to the second end of its associated resonator patch portion and partially disposed perpendicular to the second end of its associated resonator patch portion.

3. The antenna structure of claim 1, wherein each of the leg portions has an "L" shape.

4. The antenna structure of claim 1, wherein the antenna patches are resonating radiation patches positioned to overlap at least a portion of one of the resonator patch portions.

5. The antenna structure of claim 1, wherein each of the plurality of antenna patches has a length and a width, the length being chosen for resonance, and the width being chosen for impedance matching.

6. The antenna structure of claim 1, wherein the antenna patches are non-resonating radiation patches positioned to overlap at least a portion of one of the first or second resonator portions.

* * * * *